US006536047B1

(12) United States Patent
Mullaly

(10) Patent No.: US 6,536,047 B1
(45) Date of Patent: Mar. 25, 2003

(54) INFANT HOLDING GARMENT

(76) Inventor: Kandi A. Mullaly, 11113 Bondurant Dr., Richmond, VA (US) 23236

( * ) Notice: Subject to any disclaimer, the term of this patent is extended or adjusted under 35 U.S.C. 154(b) by 0 days.

(21) Appl. No.: 10/175,187

(22) Filed: Jun. 19, 2002

Related U.S. Application Data

(60) Provisional application No. 60/345,251, filed on Oct. 22, 2001.

(51) Int. Cl.[7] ..... A41D 13/04

(52) U.S. Cl. ..... 2/48

(58) Field of Search ..... 2/48, 91, 92, 69.5, 2/69, 84, 86, 87, 88; D2/861; D6/603

(56) References Cited

U.S. PATENT DOCUMENTS

| | | | | |
|---|---|---|---|---|
| 2,706,817 | A | | 4/1955 | Schneider |
| 2,722,685 | A | * | 11/1955 | Lucas ..... 2/48 |
| 2,879,514 | A | | 3/1959 | Shapiro |
| 3,034,132 | A | | 5/1962 | Landsberger et al. |
| 3,629,865 | A | * | 12/1971 | Weiner ..... 2/48 |
| 3,952,332 | A | * | 4/1976 | Tanner ..... 2/48 |
| 4,125,903 | A | | 11/1978 | Farrell |
| 4,149,687 | A | | 4/1979 | Nunemacher |
| D275,827 | S | * | 10/1984 | Henry ..... D6/608 |
| 4,685,154 | A | | 8/1987 | Smith |
| 4,873,725 | A | | 10/1989 | Mitchell |
| D311,087 | S | * | 10/1990 | Pickard ..... D2/861 |
| 5,218,721 | A | * | 6/1993 | Mathews et al. ..... 2/49.2 |
| 5,321,863 | A | | 6/1994 | Yamaguchi et al. |
| D398,140 | S | * | 9/1998 | Lion ..... D2/861 |
| 5,950,235 | A | | 9/1999 | Tata |
| 5,956,762 | A | * | 9/1999 | Adams ..... 2/48 |
| 5,960,471 | A | | 10/1999 | Burton |
| D416,664 | S | * | 11/1999 | Ahmad ..... D2/864 |
| 6,105,170 | A | | 8/2000 | Lisciandro et al. |
| 6,156,410 | A | | 12/2000 | Bassler |
| 6,389,597 | B1 | | 5/2002 | Henegan |

* cited by examiner

*Primary Examiner*—John J. Calvert
*Assistant Examiner*—Alissa L. Hoey
(74) *Attorney, Agent, or Firm*—Hunton & Williams

(57) ABSTRACT

An infant holding garment comprises a back portion and a front portion. The back portion has front and back sides, a first opposing vertical edge which has an upper portion and a lower portion, a second opposing vertical edge which has an upper portion and a lower portion, a top edge, a bottom edge, and an attachment device. The attachment devices is substantially near the top edge. The front portion has front and back sides, a first opposing vertical edge which has an upper portion and a lower portion, a second opposing vertical edge which has an upper portion and a lower portion, a convex top edge, and a bottom edge. Accordingly, the front portion and the back portion are configurable to form a pouch.

37 Claims, 6 Drawing Sheets

INFANT HOLDING GARMENT

This application claims the priority of U.S. Provisional Patent Application No. 60/345,251 filed on Oct. 22, 2001, which is incorporated herein by reference in its entirety.

FIELD OF THE INVENTION

This invention relates generally to a infant holding garment and a method for holding an infant using an infant holding garment.

BACKGROUND OF THE INVENTION

Caring for an infant, such as while feeding, changing, and bathing, often exposes the caregiver to fluids and other substances, both from the environment and emanating from the infant. These fluids and other substances will often result in the caregiver's clothes becoming wet or dirty. Caring for an infant also often involves the infant being clad in only a diaper, or even without any clothing, for periods of time. It is possible for the infant to become cold during these periods of time, which is uncomfortable, and possibly unhealthy, for the infant.

Conventional child care garments, while protecting the caregiver's clothes, do not facilitate keeping the infant warm while being held. Conventional baby blankets, while keeping the infant warm, do not provide a safe and easy way of holding the infant, while also protecting the caregiver's clothes.

Accordingly, conventional techniques and products for holding an infant do not provide a simple and easy to use child care garment that both protects the caregiver's clothes while keeping the infant warm.

SUMMARY OF THE INVENTION

It is therefore desirable that the invention overcome these and other drawbacks of present child care garments and methods.

Thus, there is a need to provide an infant holding garment that is easy to use, provides protection to the caregiver's clothes, and keeps the infant warm.

To achieve this invention, as embodied and broadly described herein, an infant holding garment is provided. The infant holding garment comprises a back portion and a front portion. The back portion has front and back sides, a first opposing vertical edge which has an upper portion and a lower portion, a second opposing vertical edge which has an upper portion and a lower portion, a top edge, a bottom edge, and an attachment device. The attachment device is substantially near the top edge. The front portion has front and back sides, a first opposing vertical edge which has an upper portion and a lower portion, a second opposing vertical edge which has an upper portion and a lower portion, a convex top edge, and a bottom edge.

Accordingly, the front portion and the back portion are configurable to form a pouch. The pouch is formed when the bottom edge of the front portion is affixed substantially near the bottom edge of the back portion, the lower portion of the first opposing vertical edge of the front portion is affixed substantially near the lower portion of the first opposing vertical edge of the back portion, and the lower portion of the second opposing vertical edge of the front portion is affixed substantially near the lower portion of the second opposing vertical edge of the back portion. The garment is worn by an individual utilizing the attachment device, such that the back side of the back portion is adjacent to the individual. This allows the garment to protect the individual while placing the infant in the pouch. Moreover, with at least a substantial portion of the infant being held in the pouch, this facilitates keeping the infant warm.

In a further embodiment of the invention, an infant holding garment further includes a hood portion, which has a straight edge and a convex edge. Accordingly, the convex edge of the hood portion is affixed to the top edge on the back side of the front portion, forming a hood for placement over the head of the infant. This further facilitates keeping the infant warm.

The accompanying drawings, which are incorporated in and constitute a part of this specification, illustrate embodiments of the invention and together with the description, serve to explain the principles of the invention.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF THE INVENTION

Reference will now be made in detail to the present preferred embodiment of the invention. An example is illustrated in the accompanying drawings, in which reference indicators refer to corresponding elements and like reference indicators are used to designate like elements.

Figure 1:
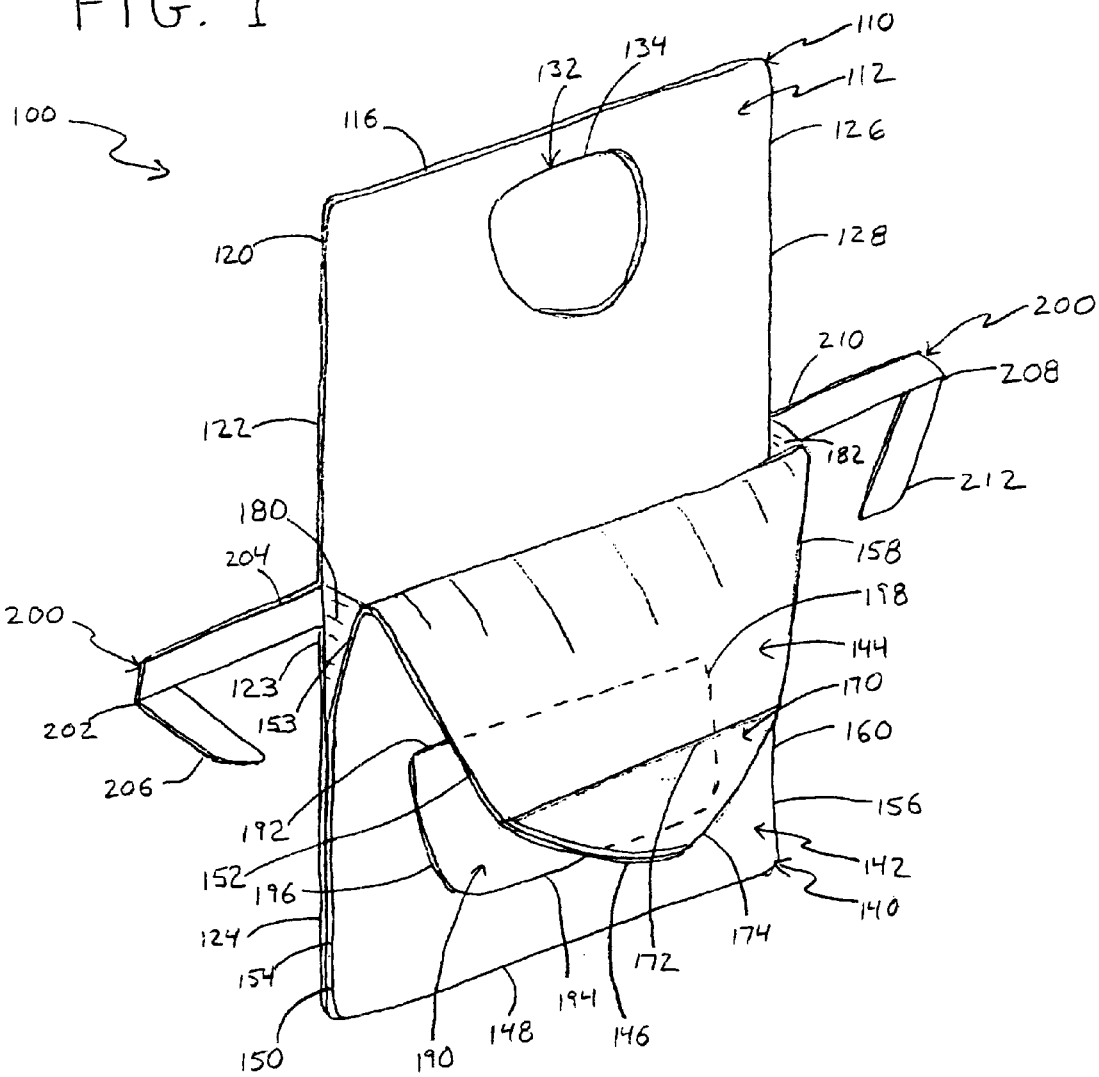
FIG. 1 is a front isometric view of an illustrative infant holding garment in accordance with one embodiment of the invention.

As shown in FIG. 1, an illustrative infant holding garment 100 is provided in accordance with one embodiment of the invention. The infant holding garment 100 includes a back portion 110, a front portion 140, a hood portion 170, a first extension portion 180, a second extension portion 182, a pocket portion 190, and a securing device 200.

Back portion 110 has a front side 112, a top edge 116, a first opposing vertical edge 120, a second opposing vertical edge 126, and an attachment device 132. The back side 114 and bottom edge 118 of back portion 110 are presented in FIG. 3. First opposing vertical edge 120 further includes an upper portion 122, a lower portion 124, and a center 123. Second opposing vertical edge 126 further includes an upper portion 128, a lower portion 130 (shown in FIG. 3), and a center 129 (shown in FIG. 3). Attachment device 132 comprises a circular opening 134. Attachment device 132 is substantially near top edge 116.

It should be appreciated that the back portion 110 provides the foundation for the garment. The attachment device 132, allows the garment to be worn by an individual, with the back portion 110 adjacent to the individual's body. In this embodiment, the individual's head is disposed through the circular opening 134, such that the garment hangs from the individual's neck. The back portion 110 protects the individual's clothes. The back portion 110 may be constructed of any suitable material or absorbent fabric, such as cotton terry cloth. Additionally, the back portion 110 may be constructed of two layers, with the layer adjacent to the individual constructed of any suitable water-resistant fabric, such as nylon.

Front portion 140 has a front side 142, a back side 144, a top edge 146, a bottom edge 148, a first opposing vertical edge 150, and a second opposing vertical edge 156. First opposing vertical edge 150 further includes an upper portion 152, a lower portion 154, and a center 153. Second opposing vertical edge 156 further includes an upper portion 158, a lower portion 160, and a center 159 (shown in FIG. 2). It should be appreciated that the front portion 140 may also be constructed of any suitable material or absorbent fabric, such as cotton terry cloth.

The front portion 140 and the back portion 110 are configurable to form a pouch when the bottom edge 148 of the front portion is affixed substantially near the bottom edge 118 of the back portion, the lower portion 154 of the first opposing vertical edge of the front portion is affixed substantially near the lower portion 124 of the first opposing vertical edge of the back portion, and the lower portion 160 of the second opposing vertical edge of the front portion is affixed substantially near the lower portion 130 of the second opposing vertical edge 126 of the back portion 110.

It should be appreciated that the pouch may be used for a variety of purposes. A substantial portion of an infant or small animal may be placed in the pouch to be kept warm. Additionally, a wet infant or small animal may be placed in the pouch after bathing or swimming, such that the pouch will facilitate retaining warmth and drying the infant or small animal. The front portion 140 may be affixed to the back portion 110 using any suitable technique known for making clothing.

Hood portion 170 has a straight edge 172 and a convex edge 174. Pocket portion 190 has a top edge 192, a bottom edge 194, a first opposing vertical edge 196, and a second opposing vertical edge 198. Securing device 200 has a first portion 202 and a second portion 208. First portion 202 further includes a first end 204 and a second end 206. Second portion 208 further includes a first end 210 and a second end 212. The convex edge 174 of the hood portion 170 is affixed to the top edge 146 on the back side of the front portion, forming a hood.

It should be appreciated that the hood may be placed over the head of an infant or small animal which has been placed in the pouch, preventing heat loss from the head and facilitating drying of the head. The hood portion 170 may be affixed to the top edge 146 of the front portion using any suitable technique known for making clothing. The hood portion 170 may be constructed of any suitable material or absorbent fabric, such as cotton terry cloth. The hood portion 170 may be constructed of two layers of fabric, with the layer not adjacent to the front portion having a decorative print.

The first extension portion 180 is affixed between the first opposing vertical edge 150 of the front portion and the first opposing vertical edge 120 of the back portion, substantially near the center 153 of the first opposing vertical edge of the front portion and the center 123 of the first opposing vertical edge of the back portion. The second extension portion 182 is affixed between the second opposing vertical edge 156 of the front portion and the second opposing vertical edge 126 of the back portion, substantially near the center 159 of the second opposing vertical edge of the front portion and the center 129 of the second opposing vertical edge of the back portion.

It should be appreciated that the first extension portion 180 and the second extension portion 182 expand the size of the opening of the pouch. The larger pouch opening facilitates easier placement of an infant or small animal into the pouch. The first extension portion 180 and the second extension portion 182 may be affixed to the back portion 110 and front portion 140 using any suitable technique known for making clothing. The first extension portion 180 and the second extension portion 182 may be constructed of any suitable material or absorbent fabric, such as cotton terry cloth, or any suitable elasticized fabric.

The pocket portion 190 is positioned substantially near the bottom edge 148 of the front portion, adjacent to the front side 142 of the front portion, and the first opposing vertical edge 196, the second opposing vertical edge 198, and the bottom edge 194 of the pocket portion are affixed to the front portion, forming a pocket.

It should be appreciated that the pocket formed may be used to hold items used while holding, caring for, or bathing an infant or small animal, such as pacifiers, shampoo, or bath toys. The pocket may be constructed with a detachable fastening device between the pocket portion 190 and the front portion 140, substantially near the top edge 192 of the pocket portion, such that items in the pocket can be secured. A flap closure may be constructed for the pocket by affixing an additional piece of fabric to the front portion 140, immediately superior to the pocket portion 190. The flap closure may be constructed with a detachable fastening device. Additionally, a plurality of pockets may be affixed to the front portion 140, providing an increased storage capacity. The pocket portion 190 may be affixed to the front portion 140 using any suitable technique known for making clothing. The pocket portion 190 may be constructed of any suitable material or fabric, such as cotton terry cloth or fabric with a decorative print.

The first end 204 of the first portion of the securing device is affixed to the first opposing vertical edge 120 of the back portion and the first end 210 of the second portion of the securing device is affixed to the second opposing vertical edge 126 of the back portion. Alternatively, the first end 204 may be affixed to the first opposing vertical edge 150 of the front portion and the first end 210 may be affixed to the second opposing vertical edge 156 of the front portion.

It should be appreciated that the second end 206 of the first portion and the second end 212 of the second portion of the securing device are brought around opposing sides of the individual and tied together behind the individual, securing the garment at the individual's waist. Alternatively, a detachable fastening device may be affixed to the second end 206 and the second end 212, such that second end 206 and the second end 212 are secured behind the individual's waist using the detachable fastening device. The securing device 200 functions together with the attachment device 132 to hold the garment to the individual. The securing device 200 may be affixed to the back portion 110 using any suitable technique known for making clothing. The securing device 200 may be constructed of any suitable material or fabric, such as cotton terry cloth.

Figure 2:
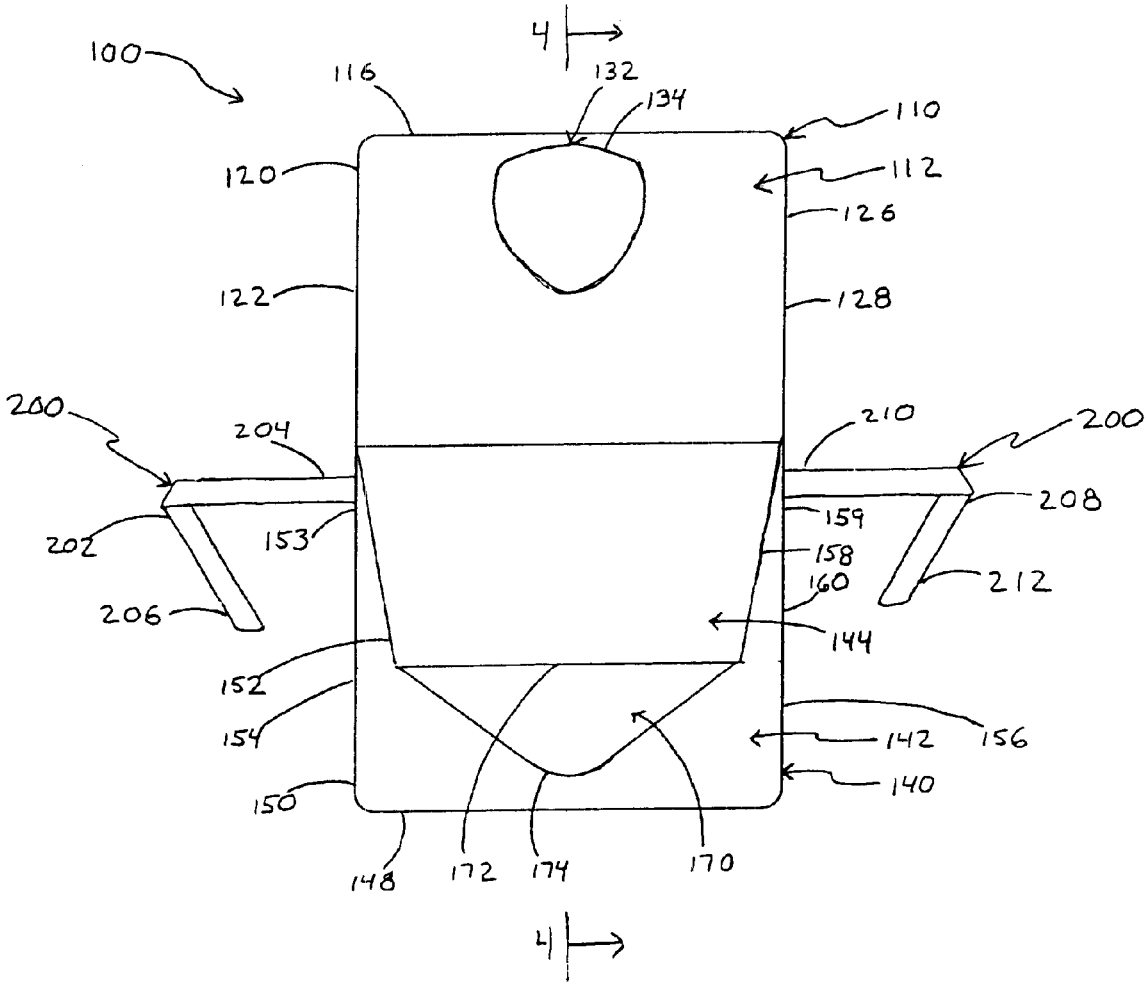
FIG. 2 is a front view of the illustrative infant holding garment of FIG. 1 in accordance with one embodiment of the invention.
Figure 3:
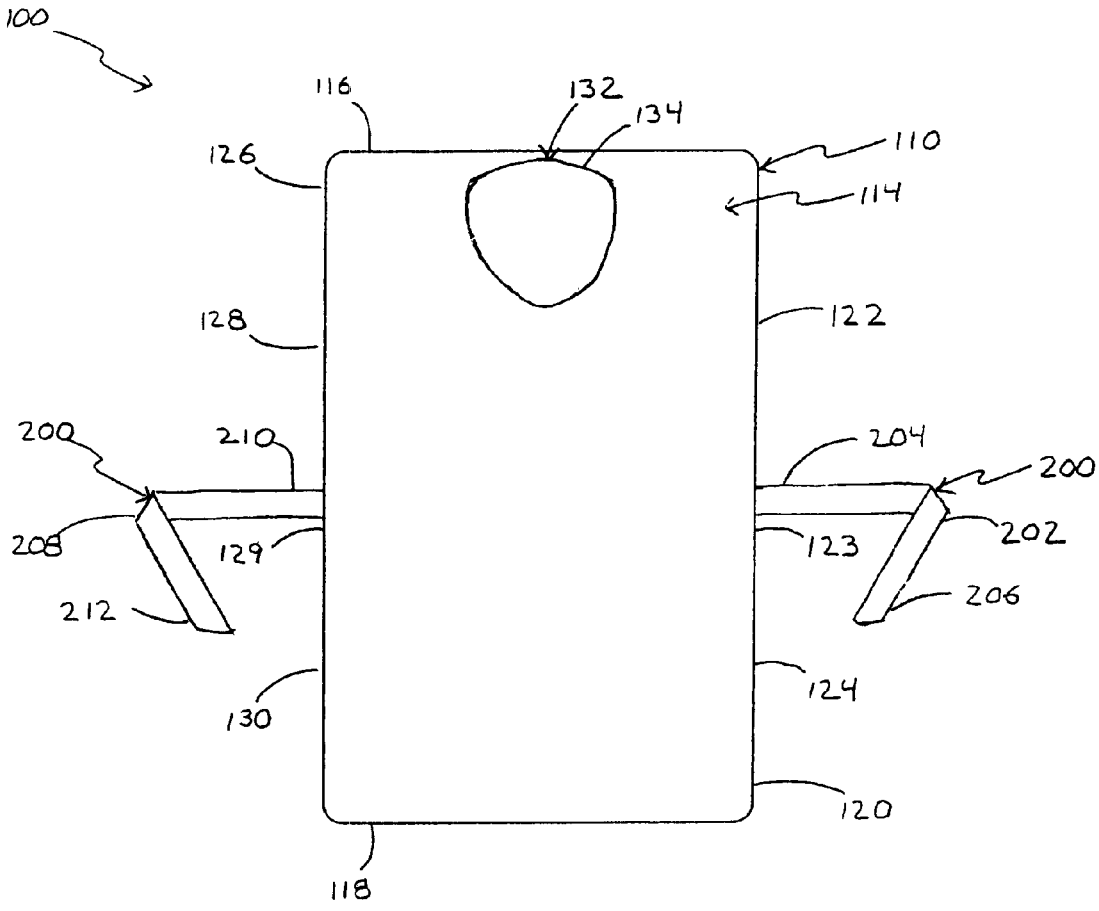
FIG. 3 is a rear view of the illustrative infant holding garment of FIG. 1 in accordance with one embodiment of the invention.
Figure 4:
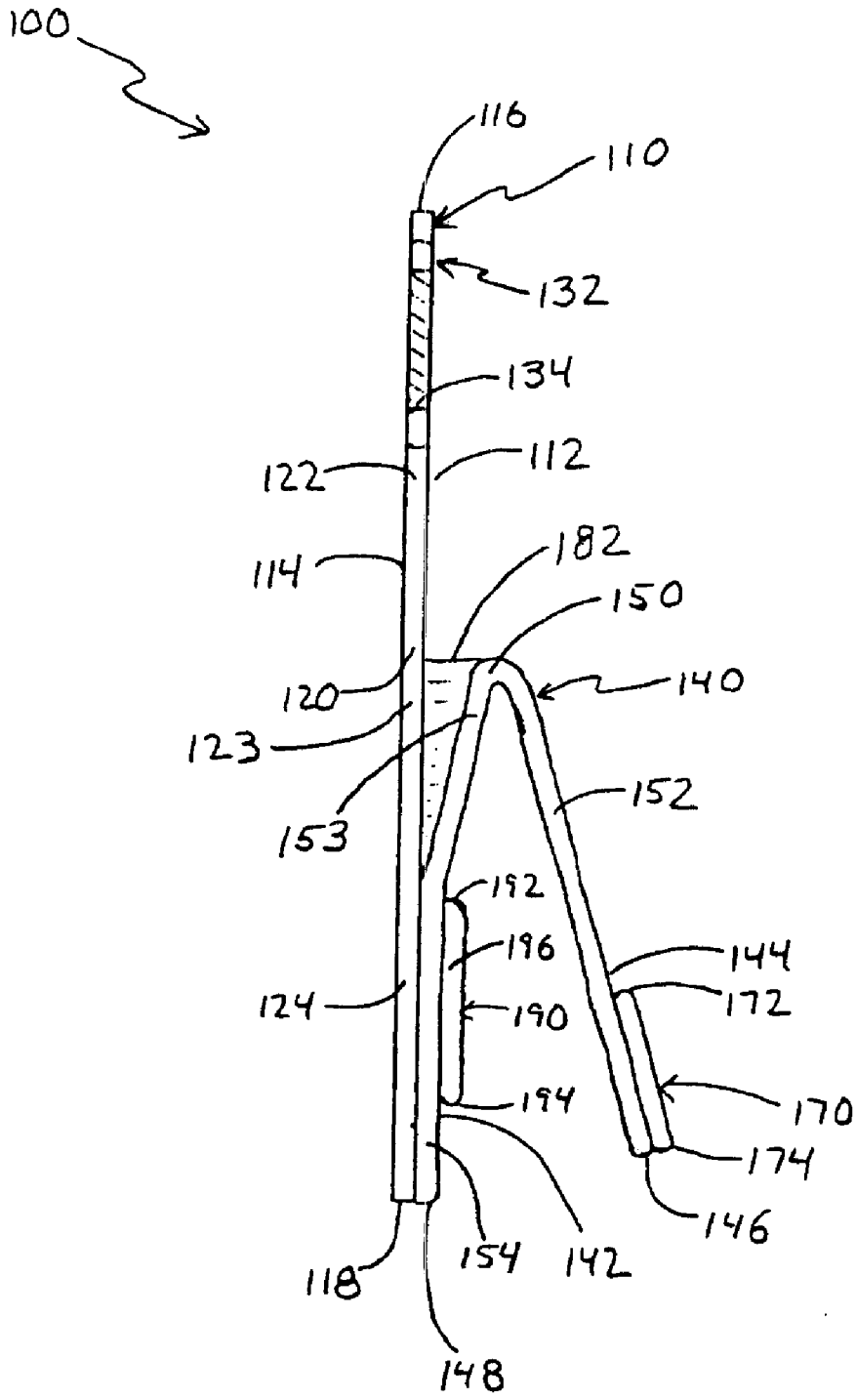
FIG. 4 is a side view of the illustrative infant holding garment of FIG. 1 in accordance with one embodiment of the invention.

FIG. 2 illustrates infant holding garment 100 in front view. The back portion 110, front portion 140, hood portion 170, and securing device 200 are shown in FIG. 2. As further shown in FIG. 2, the second opposing vertical edge of the front portion has a center 159. FIG. 3 illustrates infant holding garment 100 in rear view. The back portion 110 and securing device 200 are shown in FIG. 3. As further shown in FIG. 3, back portion 110 has a back side 114 and a bottom edge 118. The second opposing vertical edge has a center 129 and a lower portion 130. FIG. 4 illustrates infant holding garment 100 in side view. The back portion 110, front portion 140, hood portion 170, second extension portion 182, and pocket portion 190 are shown in FIG. 4.

Referring to FIGS. 1–4, it should be appreciated that infant holding garment 100 is configured to be worn by an individual while holding an infant in a pouch formed between the back portion 110 and the front portion 140. As described above, FIG. 5 is a front perspective view of the illustrative infant holding garment 100 shown worn by an illustrative caregiver who is holding an illustrative infant in the pouch. The back portion 110, front portion 140, hood portion 170, first extension portion 180, pocket portion 190, and securing device 200 are shown in FIG. 5.

Figure 5:
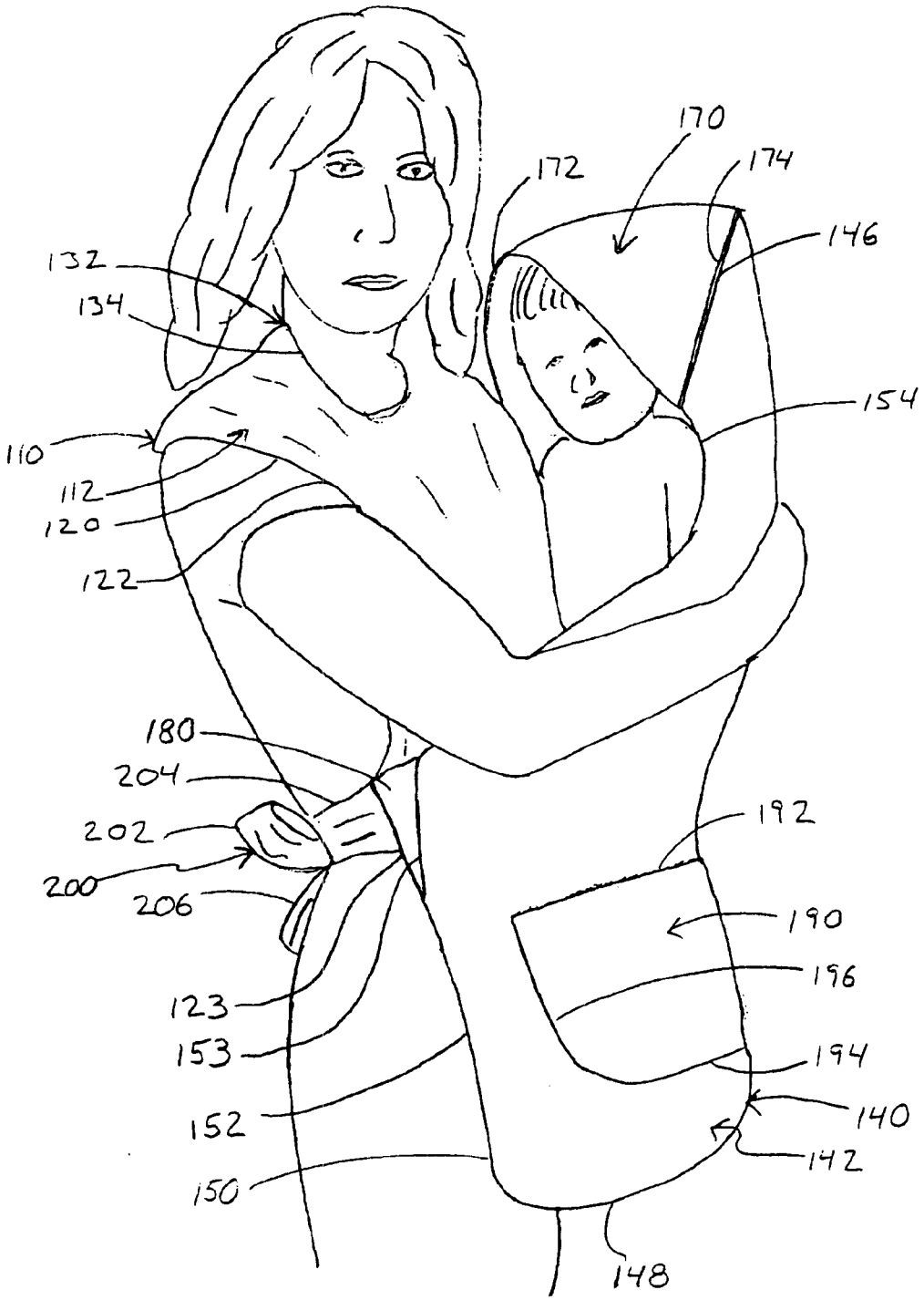
FIG. 5 is a front perspective view of the illustrative infant holding garment of FIG. 1 shown worn by an illustrative caregiver who is holding an illustrative infant in the pouch in accordance with one embodiment of the invention.

It should be appreciated that the infant holding garment 100 can be worn by an individual by disposing the individual's head through the circular opening 134, such that the back portion 110 is adjacent to the individual's body, as illustrated in FIG. 5. The securing device 200 can be tied around the individual's waist. The infant can be placed into the pouch formed between the back portion 110 and the front portion 140, and the hood portion 170 can be placed over the infant's head.

Figure 6:
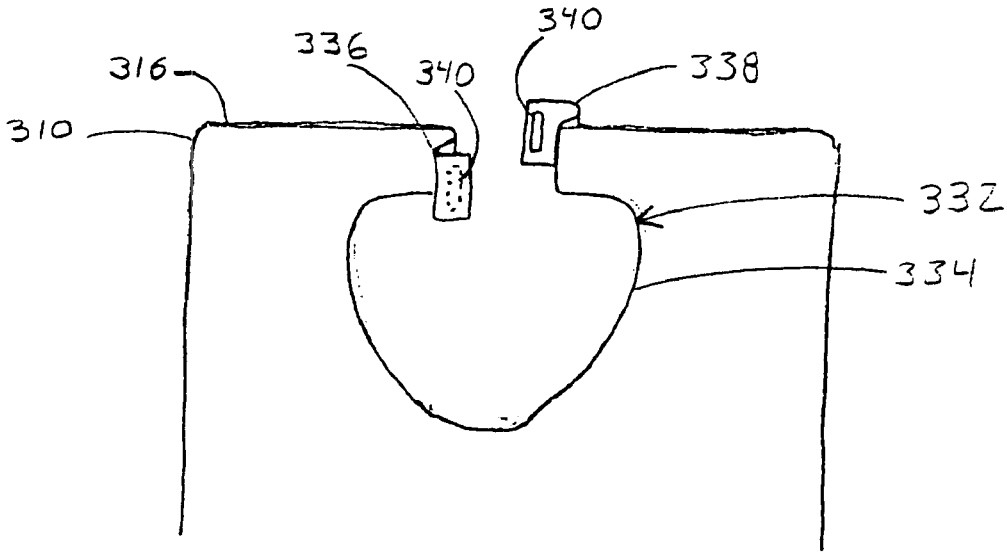
FIG. 6 is a front view of an illustrative attachment device in accordance with one further embodiment of the invention.

FIG. 6 is a front view of an illustrative attachment device in accordance with a further embodiment of the invention. The attachment device 332 is on the back portion 310 of the garment, substantially near the top edge 316. The attachment device 332 further comprises a circular opening 334. The portion of the attachment device 332 adjacent to the top edge 316 is separated into a first adjacent piece 336 and a second adjacent piece 338. A detachable fastening device 340 is affixed to the first adjacent piece 336 and the second adjacent piece 338.

It should be appreciated that this embodiment comprising attachment device 332 could be donned by separating the first adjacent piece 336 and the second adjacent piece 338, bringing the first adjacent piece 336 and the second adjacent piece 338 around opposing sides of the individual's neck thereby disposing the individual's neck into the circular opening 334, and fastening the detachable fastening device 340 behind the individual's neck.

Figure 7:
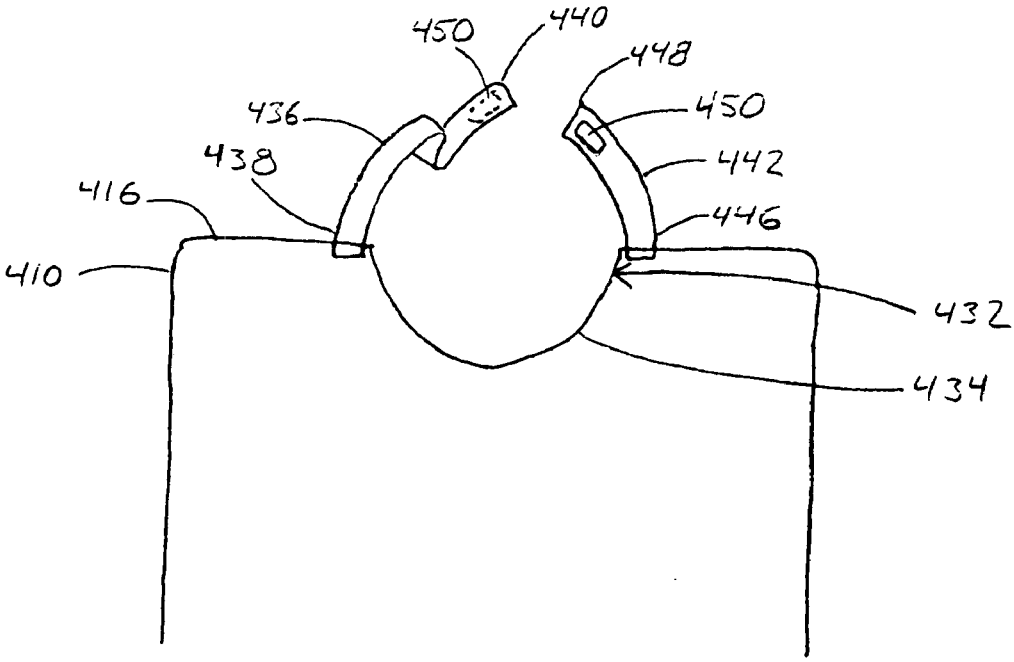
FIG. 7 is a front view of an illustrative attachment device in accordance with one further embodiment of the invention.

FIG. 7 is a front view of an illustrative attachment device in accordance with a further embodiment of the invention. The attachment device 432 is on the back portion 410 of the garment. The attachment device 432 comprises a concave notch 434 in the top edge 416, a first strap portion 436, and a second strap portion 442. The first strap portion 436 further includes a first end 438 and a second end 440. The second strap portion 442 further includes a first end 446 and a second end 448. The first end 438 of the first strap portion is affixed to the top edge 416 on one side of the concave notch 434, and the first end 446 of the second strap portion is affixed to the top edge 416 on the opposing side of the concave notch 434. A detachable fastening device 450 is affixed to the second end 440 of the first strap portion and to the second end 448 of the second strap portion.

It should be appreciated that this embodiment comprising attachment device 432 could be donned by separating the second end 440 of the first strap portion and the second end 448 of the second strap portion, bringing the second end 440 and the second end 448 around opposing sides of the individual's neck thereby disposing the individual's neck into the concave notch 434, and fastening the detachable fastening device 440 behind the individual's neck.

It should further be appreciated that additional embodiments of the attachment device are possible, such as a concave notch with a single strap portion affixed on one end and detachably fastened on the other end, or such as a concave notch with a single strap portion affixed on both ends and donned by disposing the individual's head through the opening created by the concave notch and the single strap portion, for example.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the claims and their legal equivalents.

I claim:

1. A garment, worn by an individual for holding an infant or small animal, comprising:

a back portion, having a front side and a back side, a first opposing vertical edge having an upper portion, a lower portion, and a center, a second opposing vertical edge having an upper portion, a lower portion, and a center, a top edge, a bottom edge, and an attachment device substantially near the top edge;

a front portion, having a front side and a back side, a first opposing vertical edge having an upper portion, a lower portion, and a center, a second opposing vertical edge having an upper portion, a lower portion, and a center, a convex top edge, and a bottom edge; and a hood portion, having a straight edge and a convex edge;

wherein the front portion and the back portion being configurable to form a pouch when the bottom edge of the front portion is affixed substantially near the bottom edge of the back portion, the lower portion of the first opposing vertical edge of the front portion is affixed substantially near the lower portion of the first opposing vertical edge of the back portion, and the lower portion of the second opposing vertical edge of the front portion is affixed substantially near the lower portion of the second opposing vertical edge of the back portion; the garment is wearable by an individual utilizing the attachment device, such that the back side of the back portion is adjacent to the individual so that the garment protects the individual while placing the infant or small animal in the pouch, with at least a substantial portion of the infant or small animal being held in the pouch to facilitate keeping the infant warm; the convex edge of the hood portion is affixed to the top edge on the back side of the front portion, forming a hood for placement over the head of the infant or small animal, facilitating drying its head and keeping it warm.

2. The garment of claim 1, wherein the garment is wearable by an individual while bathing an infant or small animal so that the garment protects the individual, and placing a substantial portion of the infant or small animal in the pouch after bathing facilitates the drying of the infant or small animal.

3. The garment of claim 1, wherein the attachment device is a substantially circular opening, such that the garment may be donned by placing the individual's head through the opening.

4. The garment of claim 1, wherein the attachment device is a substantially circular opening, with an adjacent segment of the back portion separated into two adjacent pieces, and a detachable fastening device affixed to the two adjacent pieces, such that the garment may be donned by bringing the two adjacent pieces around opposing sides of the individual's neck such that the individual's neck is disposed in the opening, and fastening the detachable fastening device.

5. The garment of claim 1, wherein the attachment device is a concave notch in the top edge of the back portion, and a strap portion, the strap portion having a first end and a second end, the first end and the second end being affixed to the top edge, such that the individual's neck is disposed in the opening created between the strap portion and the concave notch.

6. The garment of claim 5, wherein the second end of the strap portion is attached to the top edge with a detachable fastening device.

7. The garment of claim 1, wherein the attachment device is a concave notch in the top edge of the back portion, a first strap portion having a first end and a second end, and a second strap portion having a first end and a second end, the first end of the first strap portion and the first end of the second strap portion being affixed to the top edge of the back portion, the second end of the first strap portion and the second end of the second strap portion having a detachable fastening device, such that the garment may be donned by disposing the individual's neck into the concave notch and bringing the second ends of the first and second strap portions around opposing sides of the individual's neck and fastening the detachable fastening device behind the individual's neck.

8. The garment of claim 1, further comprising:

a first extension portion, having a triangular shape, and a second extension portion, having a triangular shape;

wherein the first extension portion is affixed between the first opposing vertical edges of the front and back portions, substantially near the centers of the first opposing vertical edges of the front and back portions, and the second extension portion is affixed between the second opposing vertical edges of the front and back portions, substantially near the centers of the second opposing vertical edges of the front and back portions, thereby enlarging the pouch opening.

9. The garment of claim 1, further comprising:

a pocket portion, having a first opposing vertical edge, a second opposing vertical edge, a top edge, and a bottom edge;

wherein the pocket portion is positioned substantially near the bottom edge of the front portion, adjacent to the front side of the front portion, and the first opposing vertical edge, the second opposing vertical edge, and the bottom edge of the pocket portion is affixed to the front portion, forming a pocket for holding bath accessories or other items.

10. The garment of claim 1, further comprising:

two or more pockets, formed substantially similar to the pocket detailed in claim 9.

11. The garment of claim 1, further comprising:

a securing device, having a first portion and a second portion, the first portion having a first end and a second end, the second portion having a first end and a second end;

wherein the first end of the first portion of the securing device being affixed to the first opposing vertical edge of the back portion, the first end of the second portion of the securing device being affixed to the second opposing vertical edge of the back portion, and the second ends of the first and second portions of the securing device are brought around opposing sides of the individual and tied together behind the individual, securing the garment at the individual's waist.

12. The garment of claim 11, further comprising:

a detachable fastening device being affixed to the second ends of the first and second portions of the securing device;

wherein the second ends of the first and second portions of the securing device are fastened together behind the individual by the detachable fastening device.

13. The garment of claim 1, wherein the garment is constructed of absorbent material, such as cotton terry cloth.

14. A garment comprising:

a back portion, having a front side and a back side, a first opposing vertical edge having an upper portion, a lower portion, and a center, a second opposing vertical edge having an upper portion, a lower portion, and a center, a top edge, a bottom edge, and an attachment device substantially near the top edge; and a front portion, having a front side and a back side, a first opposing vertical edge having an upper portion, a lower portion, and a center, a second opposing vertical edge having an upper portion, a lower portion, and a center, a convex top edge, and a bottom edge; and a hood portion, having a straight edge and a convex edge; and a first extension portion, having a triangular shape, and a second extension portion, having a triangular shape; and a pocket portion, having a first opposing vertical edge, a second opposing vertical edge, a top edge, and a bottom edge; and a securing device, having a first portion and a second portion, the first portion having a first end and a second end, the second portion having a first end and a second end;

wherein the front portion and the back portion being configurable to form a pouch when the bottom edge of the front portion is affixed substantially near the bottom edge of the back portion, the lower portion of the first opposing vertical edge of the front portion is affixed substantially near the lower portion of the first opposing vertical edge of the back portion, and the lower portion of the second opposing vertical edge of the front portion is affixed substantially near the lower portion of the second opposing vertical edge of the back portion; the garment is wearable by an individual utilizing the attachment device, such that the back side of the back portion is adjacent to the individual so that the garment protects the individual's clothes while bathing an infant or small animal; and at least a substantial portion of the infant or small animal being disposable into the pouch after bathing to facilitate the drying of the infant or small animal; and wherein the convex edge of the hood portion is affixed to the top edge on the back side of the front portion, forming a hood for placement over the head of the infant or small animal, facilitating drying its head and keeping it warm; and wherein the first extension portion is affixed between the first opposing vertical edges of the front and back portions, substantially near the centers of the first opposing vertical edges of the front and back portions, and the second extension portion is affixed between the second opposing vertical edges of the front and back portions, substantially near the centers of the second opposing vertical edges of the front and back portions, enlarging the pouch opening; and wherein the pocket portion is positioned substantially near the bottom edge of the front portion, adjacent to the front side of the front portion, and the first opposing vertical edge, the second opposing vertical edge, and the bottom edge of the pocket portion are affixed to the front portion, forming a pocket for holding bath accessories or other items; and wherein the first end of the first portion of the securing device being affixed to the first opposing vertical edge of the back portion, the first end of the second portion of the securing device being affixed to the second opposing vertical edge of the back portion, and the second ends of the first and second portions of the securing device are brought around opposing sides of the individual and tied together behind the individual, securing the garment at the individual's waist.

15. The garment of claim 14, wherein the attachment device is a substantially circular opening, such that the garment may be donned by placing the individual's head through the opening.

16. The garment of claim 14, wherein the attachment device is a substantially circular opening, with an adjacent segment of the back portion separated into two adjacent pieces, and a detachable fastening device affixed to the two adjacent pieces, such that the garment may be donned by bringing the two adjacent pieces around opposing sides of the individual's neck such that the individual's neck is disposed in the opening, and fastening the detachable fastening device.

17. The garment of claim 14, wherein the attachment device is a concave notch in the top edge of the back portion, and a strap portion, the strap portion having a first end and a second end, the first end and the second end being affixed to the top edge, such that the individual's neck is disposed in the aperture created between the strap portion and the concave notch.

18. The garment of claim 17, wherein the second end of the strap portion is attached to the top edge with a detachable fastening device.

19. The garment of claim 14, wherein the attachment device is a concave notch in the top edge of the back portion, a first strap portion having a first end and a second end, and a second strap portion having a first end and a second end, the first end of the first strap portion and the first end of the second strap portion being affixed to the top edge of the back portion, the second end of the first strap portion and the second end of the second strap portion having a detachable fastening device, such that the garment may be donned by disposing the individual's neck into the concave notch and bringing the second ends of the first and second strap portions around opposing sides of the individual's neck and fastening the detachable fastening device behind the individual's neck.

20. The garment of claim 14, further comprising:

two or more pockets, formed substantially similar to the pocket detailed in claim 15.

21. The garment of claim 14, further comprising:

a detachable fastening device being affixed to the second ends of the first and second portions of the securing device;

wherein the second ends of the first and second portions of the securing device are fastened together behind the individual by the detachable fastening device.

22. The garment of claim 14, wherein the garment is constructed of absorbent material, such as cotton terry cloth.

23. A method of holding an infant or small animal wherein a individual wears a garment comprising a back portion, an attachment device, a front portion secured to the back portion thereby forming a pouch; a hood formed integral with the top edge of the front portion; and wherein the individual places the infant or small animal into the pouch, and the individual places the hood over the infant's or small animal's head.

24. A method of toweling an infant or small animal wherein a individual wears a garment comprising a back portion, an attachment device, a front portion secured to the back portion thereby forming a pouch; a hood formed integral with the top edge of the front portion; and wherein the individual places the infant or small animal into the pouch, the individual places the hood over the infant's or small animal's head, and the individual uses the back portion and the front portion to dry the infant's or small animal's body and the hood to dry the infant's or small animal's head.

25. A garment, worn by an individual for holding an infant or small animal, comprising:

a back portion, having a front side and a back side, a first opposing vertical edge having an upper portion, a lower portion, and a center, a second opposing vertical edge having an upper portion, a lower portion, and a center, a top edge, a bottom edge, and an attachment device substantially near the top edge;

a front portion, having a front side and a back side, a first opposing vertical edge having an upper portion, a lower portion, and a center, a second opposing vertical edge having an upper portion, a lower portion, and a center, a convex top edge, and a bottom edge; and a first extension portion, having a triangular shape, and a second extension portion, having a triangular shape;

wherein the front portion and the back portion being configurable to form a pouch when the bottom edge of the front portion is affixed substantially near the bottom edge of the back portion, the lower portion of the first opposing vertical edge of the front portion is affixed substantially near the lower portion of the first opposing vertical edge of the back portion, and the lower portion of the second opposing vertical edge of the front portion is affixed substantially near the lower portion of the second opposing vertical edge of the back portion; the garment is wearable by an individual utilizing the attachment device, such that the back side of the back portion is adjacent to the individual so that the garment protects the individual while placing the infant or small animal in the pouch, with at least a substantial portion of the infant or small animal being held in the pouch to facilitate keeping the infant warm; the first extension portion is affixed between the first opposing vertical edges of the front and back portions, substantially near the centers of the first opposing vertical edges of the front and back portions, and the second extension portion is affixed between the second opposing vertical edges of the front and back portions, substantially near the centers of the second opposing vertical edges of the front and back portions, thereby enlarging the pouch opening.

26. The garment of claim 25, wherein the garment is wearable by an individual while bathing an infant or small animal so that the garment protects the individual, and placing a substantial portion of the infant or small animal in the pouch after bathing facilitates the drying of the infant or small animal.

27. The garment of claim 25, wherein the attachment device is a substantially circular opening, such that the garment may be donned by placing the individual's head through the opening.

28. The garment of claim 25, wherein the attachment device is a substantially circular opening, with an adjacent segment of the back portion separated into two adjacent pieces, and a detachable fastening device affixed to the two adjacent pieces, such that the garment may be donned by bringing the two adjacent pieces around opposing sides of the individual's neck such that the individual's neck is disposed in the opening, and fastening the detachable fastening device.

29. The garment of claim 25, wherein the attachment device is a concave notch in the top edge of the back portion, and a strap portion, the strap portion having a first end and a second end, the first end and the second end being affixed to the top edge, such that the individual's neck is disposed in the opening created between the strap portion an the concave notch.

30. The garment of claim 29, wherein the second end of the strap portion is attached to the top edge with a detachable fastening device.

31. The garment of claim 25, wherein the attachment device is a concave notch in the top edge of the back portion, a first strap portion having a first end and a second end, and a second strap portion having a first end and a second end, the first end of the first strap portion and the first end of the second strap portion being affixed to the top edge of the back portion, the second end of the first strap portion and the second end of the second strap portion having a detachable fastening device, such that the garment may be donned by disposing the individual's neck into the concave notch and bringing the second ends of the first and second strap portions around opposing sides of the individual's neck and fastening the detachable fastening device behind the individual's neck.

32. The garment of claim 25, further comprising:

a pocket portion, having a first opposing vertical edge, a second opposing vertical edge, a top edge, and a bottom edge;

wherein the pocket portion is positioned substantially near the bottom edge of the front portion, adjacent to the front side of the front portion, and the first opposing vertical edge, the second opposing vertical edge, and the bottom edge of the pocket portion is affixed to the front portion, forming a pocket for holding bath accessories or other items.

33. The garment of claim 25, further comprising:

two or more pockets, formed substantially similar to the pocket detailed in claim 32.

34. The garment of claim 25, further comprising:

a securing device, having a first portion and a second portion, the first portion having a first end and a second end, the second portion having a first end and a second end;

wherein the first end of the first portion of the securing device being affixed to the first opposing vertical edge of the back portion, the first end of the second portion of the securing device being affixed to the second opposing vertical edge of the back portion, and the second ends of the first and second portions of the securing device are brought around opposing sides of the individual and tied together behind the individual, securing the garment at the individual's waist.

35. The garment of claim 34, further comprising:

a detachable fastening device being affixed to the second ends of the first and second portions of the securing device;

wherein the second ends of the first and second portions of the securing device are fastened together behind the individual by the detachable fastening device.

36. The garment of claim 25, wherein the garment is constructed of absorbent material, such as cotton terry cloth.

37. A garment, worn by an individual for holding an infant, comprising:

a back portion, having a front side and a back side, a first opposing vertical edge having an upper portion, a lower portion, and a center, a second opposing vertical edge having an upper portion, a lower portion, and a center, a top edge, a bottom edge, and an attachment device substantially near the top edge;

a front portion, having a front side and a back side, a first opposing vertical edge having an upper portion, a lower portion, and a center, a second opposing vertical edge having an upper portion, a lower portion, and a center, a convex top edge, and a bottom edge; and a hood portion, having a straight edge and a convex edge;

wherein the front portion and the back portion being configurable to form a pouch when the bottom edge of the front portion is affixed substantially near the bottom edge of the back portion, the lower portion of the first opposing vertical edge of the front portion is affixed substantially near the lower portion of the first opposing vertical edge of the back portion, and the lower portion of the second opposing vertical edge of the front portion is affixed substantially near the lower portion of the second opposing vertical edge of the back portion; the garment is wearable by an individual such that the garment protects the individual and the pouch facilitates keeping an infant in the pouch warm; the convex edge of the hood portion is affixed to the top edge on the back side of the front portion, forming a hood for placement over the head of the infant.

* * * * *